US006899242B2

(12) United States Patent
Overholt et al.

(10) Patent No.: US 6,899,242 B2
(45) Date of Patent: May 31, 2005

(54) COLLAPSIBLE CONTAINER WITH RECESSED SIDE-PANEL LATCH

(75) Inventors: Trenton M. Overholt, Manhattan Beach, CA (US); Gerald R. Koefelda, Rowlett, TX (US)

(73) Assignee: Rehrig Pacific Company, Los Angeles, CA (US)

( * ) Notice: Subject to any disclaimer, the term of this patent is extended or adjusted under 35 U.S.C. 154(b) by 0 days.

(21) Appl. No.: 10/027,741

(22) Filed: Dec. 20, 2001

(65) Prior Publication Data

US 2003/0116564 A1 Jun. 26, 2003

(51) Int. Cl.[7] ..... B65D 6/18
(52) U.S. Cl. ..... 220/7
(58) Field of Search ..... 220/6, 7, 1.5

(56) References Cited

U.S. PATENT DOCUMENTS

| | | | | | |
|---|---|---|---|---|---|
| 3,628,683 | A | | 12/1971 | Friedrich | |
| 3,796,342 | A | | 3/1974 | Sanders et al. | |
| 3,874,546 | A | | 4/1975 | Sanders et al. | |
| 3,955,703 | A | | 5/1976 | Zebarth | |
| 4,044,910 | A | | 8/1977 | Box | |
| 4,081,099 | A | | 3/1978 | Shead | |
| 4,163,495 | A | | 8/1979 | Drader | |
| 4,235,345 | A | | 11/1980 | VandeDrink et al. | |
| 4,300,695 | A | | 11/1981 | Hsu | |
| 4,314,686 | A | | 2/1982 | März | |
| 4,674,647 | A | | 6/1987 | Gyenge et al. | |
| 4,923,079 | A | * | 5/1990 | Foy | 220/7 |
| 5,076,457 | A | | 12/1991 | Marovskis | |
| 5,398,834 | A | | 3/1995 | Umiker | |
| 5,429,261 | A | | 7/1995 | Machino | |
| 5,564,599 | A | | 10/1996 | Barber et al. | |
| 5,622,276 | A | | 4/1997 | Simmons | |
| 5,850,936 | A | | 12/1998 | Umiker | |
| 5,853,099 | A | | 12/1998 | Lessard | |
| 5,938,059 | A | * | 8/1999 | Luburic | 220/6 |
| 5,950,546 | A | | 9/1999 | Brown et al. | |
| 5,975,324 | A | | 11/1999 | Schmitt | |
| 6,015,056 | A | * | 1/2000 | Overholt et al. | 220/7 X |
| 6,073,790 | A | | 6/2000 | Umiker | |
| 6,098,827 | A | * | 8/2000 | Overholt et al. | 220/7 X |
| 6,286,701 | B1 | | 9/2001 | Umiker | |
| 6,290,081 | B1 | * | 9/2001 | Merey | 220/7 |
| 6,293,417 | B1 | | 9/2001 | Varfeldt | |
| 6,293,418 | B1 | | 9/2001 | Ogden et al. | |
| 6,460,717 | B1 | * | 10/2002 | Smyers et al. | 220/6 |

FOREIGN PATENT DOCUMENTS

| | | | |
|---|---|---|---|
| EP | 1114779 A2 | * | 7/2001 |
| NL | 1 014 717 C | | 9/2001 |

* cited by examiner

*Primary Examiner*—Stephen Castellano

(57) ABSTRACT

A collapsible container includes a base, and pairs of opposed side and end walls that are pivotally mounted on the base. When the side walls are pivoted to a raised position against inward flanges defined on the end walls, latch members on the side walls engage complementary shoulders defined on end wall flange projections to thereby lock the side walls relative to the end walls. Each latch member includes a base portion mounted proximate to a respective lateral edge of the side wall, a lever arm portion extending away from the side wall's lateral edge, and an intermediate portion having a camming surface and adjacent shoulder with which to engage the respective end wall flange projection. When raised, edge portions of each side wall are received in recessed shelves defined in the base while the side wall's inner face simultaneously engages cantilevered stop members defined in the base.

24 Claims, 8 Drawing Sheets

COLLAPSIBLE CONTAINER WITH RECESSED SIDE-PANEL LATCH

BACKGROUND OF THE INVENTION

1. Technical Field

The invention relates to a collapsible container whose panels are interlocked and latched together at their respective edges when raised to thereby provide the assembled container with improved structural integrity.

2. Background Information

The prior art teaches collapsible containers featuring a generally square or rectangular bottom panel, and two pairs of opposed side panels (the latter sometimes being referred to as respective pairs of side and end panels or "walls"). Each side panel is pivotally connected to a respective bottom panel edge to move between a raised or "assembled" position in which each side panel is roughly perpendicular to the bottom panel, and a collapsed position. The side and bottom panels may include hinge components that conveniently permit the side panels to be "snapped" into place on the bottom panel, for example, by moving the basal edge of the side panel laterally (outwardly) relative to the bottom panel's peripheral edge.

The prior art teaches the placement of latch mechanisms on the adjacent edges of the raised side panels to thereby provide the container with greater structural integrity and improved vertical stacking capability when assembled. Generally, known latch mechanisms employ a resilient, cantilevered latch member that either is flush with, or projects from the nominal lateral edge or inner face of one side panel into engagement with a complementary recess defined in the opposed edge of an adjacent side panel. An example of a flush latch member is disclosed in U.S. Pat. No. 6,073,790. The projecting latch member and, often, the complementary recess respectively include a camming surface that cooperate to urge the latch member into engagement with the recess, whereupon opposed abutting shoulders on the latch member and the recess provide a "snap-in" engagement to secure the one side panel to the other.

When such a container is to be collapsed, the latch member is resiliently biased, for example, by application of finger pressure on a portion of its length so as to swing the latch member clear of the recess or striker, whereupon the one side panel may be pivoted free of the other side panel. One or more inwardly- or outwardly-directed flanges, defined on the opposed edges of the adjacent side panels, are often used in conjunction with such latches to prevent the overtravel of one side wall relative to the other. Interlocking webbing defined within one or more such flanges may be used to further enhance the torsional rigidity of the assembled container by preventing relative movement of one side panel edge along the other side panel edge.

Unfortunately, because the quality of the resulting interconnection between adjacent side panels is dependent upon the nature of the engagement between the opposed abutting shoulders of the latch member and the corresponding recess/aperture/striker, any damage to the exposed latch member, for example, during container assembly or use, including an unintended permanent bending of the latch member relative to the nominal edge of the side panel, may impair latch functionality. Moreover, when the latch member is integrally molded with the typically polymeric side panel, such outwardly-cantilevered latch members may exhibit a reduced service life due to a bending-induced failure mode.

Accordingly, what is needed is a latch mechanism for securely interconnecting the side panels of a collapsible container featuring a resilient latch member on one side panel proximate to an edge whose camming surface and associated abutting shoulder are neither located along, nor project beyond, the panel's edge, and further featuring an improved service life relative to known, outwardly-cantilevered latch members. It is also desirable to provide an inwardly-collapsible container that includes convenient, "snap-in" hinge components on the side and bottom panels while nonetheless better resisting the application to the side wall of external lateral loads.

SUMMARY OF INVENTION

It is an object of the invention to provide a collapsible container that includes a latch mechanism for securely interconnecting the edges of adjacent, pivoting side panels, wherein the latch mechanism features featuring a resilient latch member whose camming surface and associated abutting shoulder does not define a part of, or otherwise project beyond, the edge.

It is also an object of the invention to provide a collapsible container having a latch mechanism along an edge of one side panel that engages a striker defined on an opposed edge of an adjacent side panel, wherein the striker includes an abutting shoulder that is substantially shielded by a raised flange on the adjacent side panel to thereby minimize potential damage to the striker's abutting shoulder during assembly or use of the container.

It is also an object of the invention to provide a collapsible container featuring engagement, in the assembled condition, between adjacent side panels along a substantially continuous length along their respective contiguous edges.

It is a further object of the invention to provide a collapsible container with a bottom panel and a pivoting side wall that is pivotally mounted on the bottom panel, wherein the side panel includes a latch mechanism having no part projecting beyond the panel's nominal edge.

Yet another object of the invention to provide a latch mechanism for an inwardly-collapsible container that is conveniently operated using finger pressure applied to an exterior surface on the supporting side panel.

Yet another object of the invention is to provide an inwardly-collapsible container having a side panel that is laterally bolstered when raised to thereby further resist disengagement of the basal edge of the side panel from the bottom panel in response to a lateral impact.

Yet another object of the invention is to provide a lateral bolster for a side panel of an inwardly-collapsible container that is integrally-formed in the bottom panel and that facilitates attachment of the side panel to the bottom panel.

Under the invention, a collapsible container includes a bottom panel defining a peripheral edge; and a plurality of side panels, each side panel being mounted on the bottom panel along a respective portion of the peripheral edge for pivoting movement about a respective pivot axis. A first side panel includes an outer face and a lateral edge bordering the outer face, while a second side panel includes an inner face, a lateral edge bordering the inner face, and a flange projecting from the inner face along at least a portion of the lateral edge. When respectively pivoted to a raised position relative to the bottom panel, the respective lateral edges of the first and second side panels engage each other such that the flange of the second side panel overlies the outer face of the first panel.

In accordance with the invention, the first side panel includes a latch member having a base portion mounted on the first side panel proximate to its lateral edge, a lever arm portion extending generally away from the lateral edge, and a first intermediate portion disposed between the base portion and the lever arm portion, wherein the first intermediate portion includes a first camming surface and a first shoulder adjacent to the first camming surface. The second side panel correlatively includes an inward projection, for example, integrally molded with and projecting inwardly from the second side panel's flange. The inward projection has a second camming surface and a second shoulder adjacent to the second camming surface, wherein the camming surfaces and shoulders of the latch member and the inward projection are generally disposed at a same height above the bottom panel when the first and second side panels are respectively pivoted to the raised position. In this manner, when the lateral edges of the first and second side panels are raised and brought into engagement with one another, the respective camming surfaces engage to resiliently flex the latch member, predominantly along its base portion, whereupon the respective shoulders of the latch member and the inward projection abuttingly engage to thereby interlock the first and second side panels.

In accordance with feature of the invention, the base portion of each latch member includes a pair of spaced legs joined to the intermediate portion on either side of the camming surface. Most preferably, the legs of the base portion extend to respective positions outboard of the intermediate portion of the latch member such that deflection of the latch member relative to the outer face of the first side panel generates both flexural and torsional bending of each leg. In this way, each latch member features an improved service life over known cantilevered latch members.

In accordance with another feature of the invention, the first side panel is molded, for example, from a polymeric material and includes an integrally-molded strengthening rib proximate to and, most preferably, defining the lateral edge of the first panel, such that the rib extends generally perpendicular to the pivot axis of the first side panel. Preferably, in an exemplary collapsible container in accordance with the invention, the base portion of the latch member is integrally formed with the rib. Still further, the second side panel of the collapsible container preferably includes an interior corner proximate to its lateral edge, as defined by an intersection of its inner face and its flange, and the rib defines a substantially-continuous first length along the first side panel's lateral edge that is received in the second side panel's interior corner when the first and second side panels are respectively pivoted to the raised position. In this manner, the container provides a nearly continuous engagement of the two lateral edges which serves to further protect the container's ultimate contents while further enhancing the structural integrity of the assembled container.

In accordance with yet another feature of the invention, the container's first side panel includes at least one and, preferably, two or more locating members projecting outwardly from the panel's outer face proximate to its first edge. By way of example only, in an exemplary embodiment, the locating members are raised, frustoconical bosses that are integrally molded with the first side panel. The flange of the second side panel includes at least one socket adapted to receive the at least one locating member when the first and second side panels are respectively pivoted to the raised position. As the locating members are received within the sockets, the locating members guide the engagement of the camming surfaces of the latch member and the inward projection of the first and second side panels, thereby increasing latch service life. And, once the locating members are fully received in the sockets, the locating members and sockets assist in maintaining the engagement of the opposed shoulders of the latch member and the inward projection until the latch member is resiliently flexed by application of finger pressure on the lever arm portion of the latch member.

In accordance with yet another feature of the invention, recessed shelves are preferably defined about portions of the peripheral edge of the bottom panel, for example, proximate to each lateral edge of the first side panel, and the basal edge of the first side panel pivots into engagement with the recessed shelf when the first side panel is pivoted to the raised position. Moreover, other portions of the peripheral edge of the bottom panel, for example, proximate to the midpoint of the first side panel, preferably include at least one raised flange that overlies the outer face of the first side panel when the first side panel is pivoted to the raised position. The bottom panel preferably also includes at least one integrally-molded stop member having a surface that abuttingly engages the basal edge of the one side panel when the one side panel is pivoted to the raised position. In this manner, the recessed shelves and raised flanges on the peripheral edge of the bottom panel, and the cantilevered stop members together serve to precisely locate and laterally bolster the basal edge of the first side panel when it is pivoted to the raised position, thereby improving the performance of the assembled container.

In accordance with another feature of the invention, the stop member's abutting surface is preferably defined on the free end of a cantilevered portion of the stop member that extends in the direction of the first portion of the bottom panel's peripheral edge. The cantilevered design of the stop members permits each member's free end to resiliently bend downwardly when the side panel's hinge component is snap-fit into the complementary hinge component of the bottom panel, thereby greatly facilitating assembly while thereafter serving to bolster the side panel with respect to lateral loads.

Other features, advantages and benefits of the invention will be apparent from the following description, including the accompanying Drawings.

DETAILED DESCRIPTION OF THE PREFERRED EMBODIMENT

Figure 1:
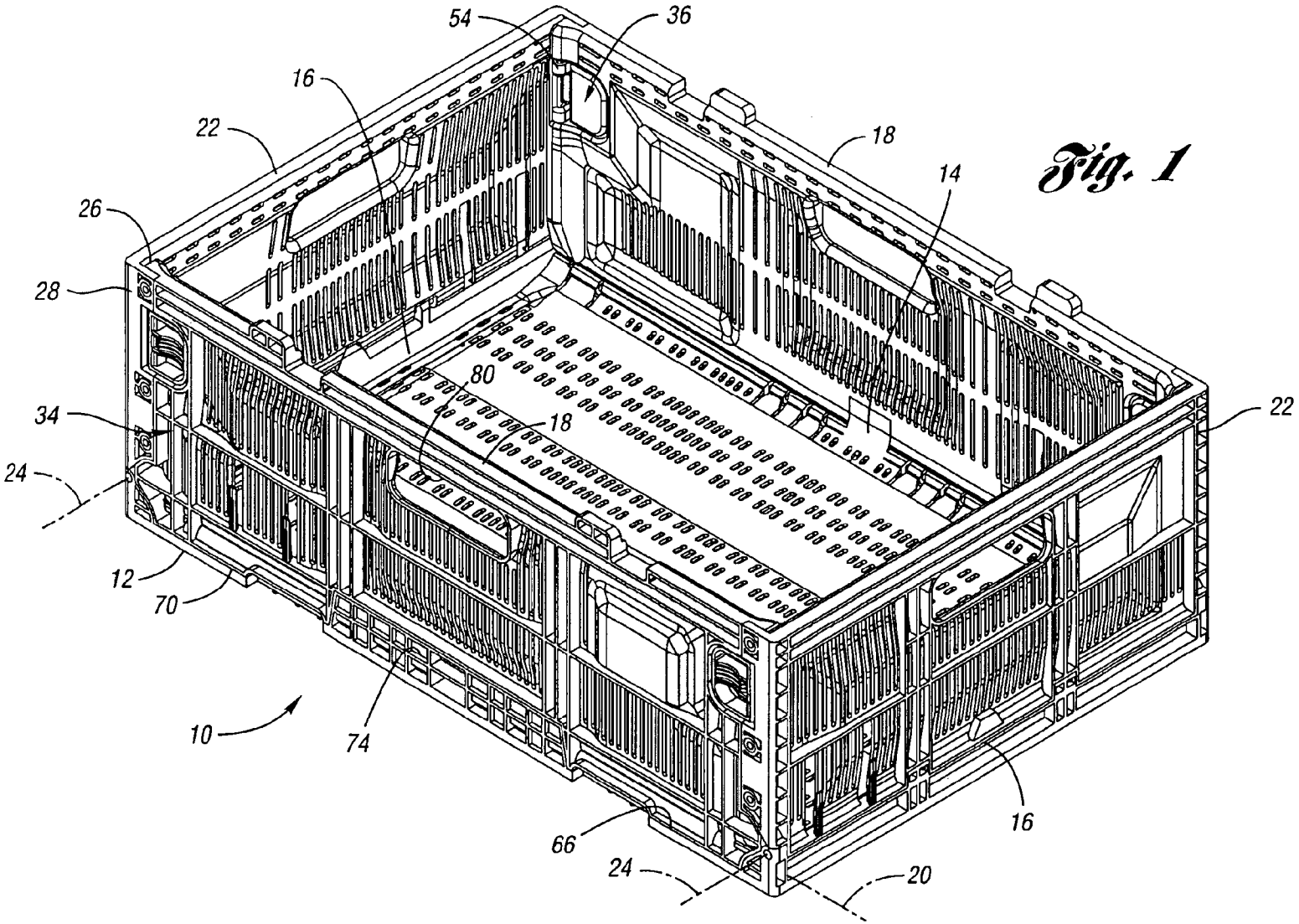
FIG. 1 is an isometric view of an exemplary collapsible container in accordance with the invention, with its side panels pivoted to the raised and interlocked position.
Figure 2:
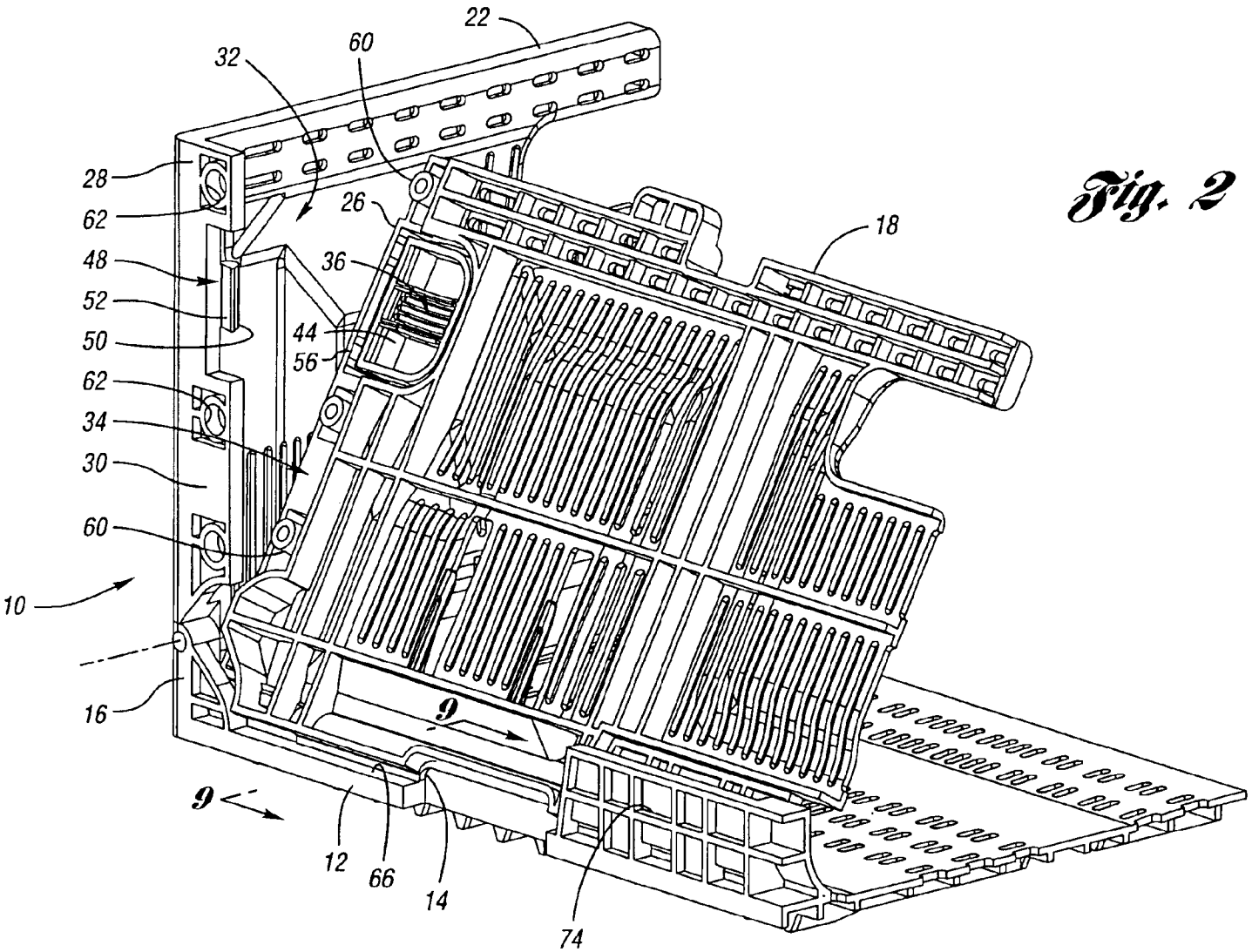
FIG. 2 is a partial, isometric view of the exemplary container of FIG. 1, with a first side panel partially inwardly collapsed to further illustrate the respective lateral edges of the first side panel and an adjacent second side panel.

FIGS. 1–10 show an exemplary inwardly-collapsible container 10 in accordance with the invention suitable, for example, for transporting and storing a variety of materials. Referring to FIGS. 1 and 2, the container 10 includes a thin, generally-rectangular bottom panel or base 12 having two pairs of opposed, raised rails 14, 16 defined about the peripheral edge of the base 12. A first pair of opposed side panels 18 (hereinafter "side walls 18," for convenience only) is pivotally attached to the first pair of opposed rails 14 to thereby respectively provide a raised pivot axis 20 for each side wall 18. The raised pivot axis 20 for each side wall 18 permits the side wall 18 to be pivoted inwardly so as to overlie at least a portion of the base 12.

A second pair of opposed side panels 22 (hereinafter "end walls 22," again, for convenience only) is similarly pivotally attached to the second pair of opposed rails 16 to thereby respectively provide a raised pivot axis 24 for each end wall 22. The raised pivot axis 24 for each end wall 22 is defined at a relative height on the base 12 above the raised pivot axis 20 of each side wall 18 to thereby permit the end walls 22 to be pivoted inwardly on top of the collapsed side walls 18 into a substantially parallel relationship with the base 12. In this manner, the container 10 is collapsed into a compact form with which to facilitate the vertical stacking of a plurality of such containers 10.

The base 12 and walls 18, 22 of the container 10 are conveniently formed or substantially formed of various types of plastic or polymeric materials (preferably thermoplastic), for example, as by an injection molding process. In a preferred embodiment, the material of the base 12 and walls 18, 22 is injection molded polypropylene. Of course, components of container 10 can be constructed using any other material suitable to this application, using any suitable process. As is well understood in the art, the thickness of the base and walls 18, 22 of the container 10 may vary depending on the intended usage and other characteristics desired from the container 10. Additionally, drainage holes and a network of integrally-formed strengthening ribs are preferably molded into the base 12 and walls 18, 22 to further improve the performance of the container 10.

Figure 3:
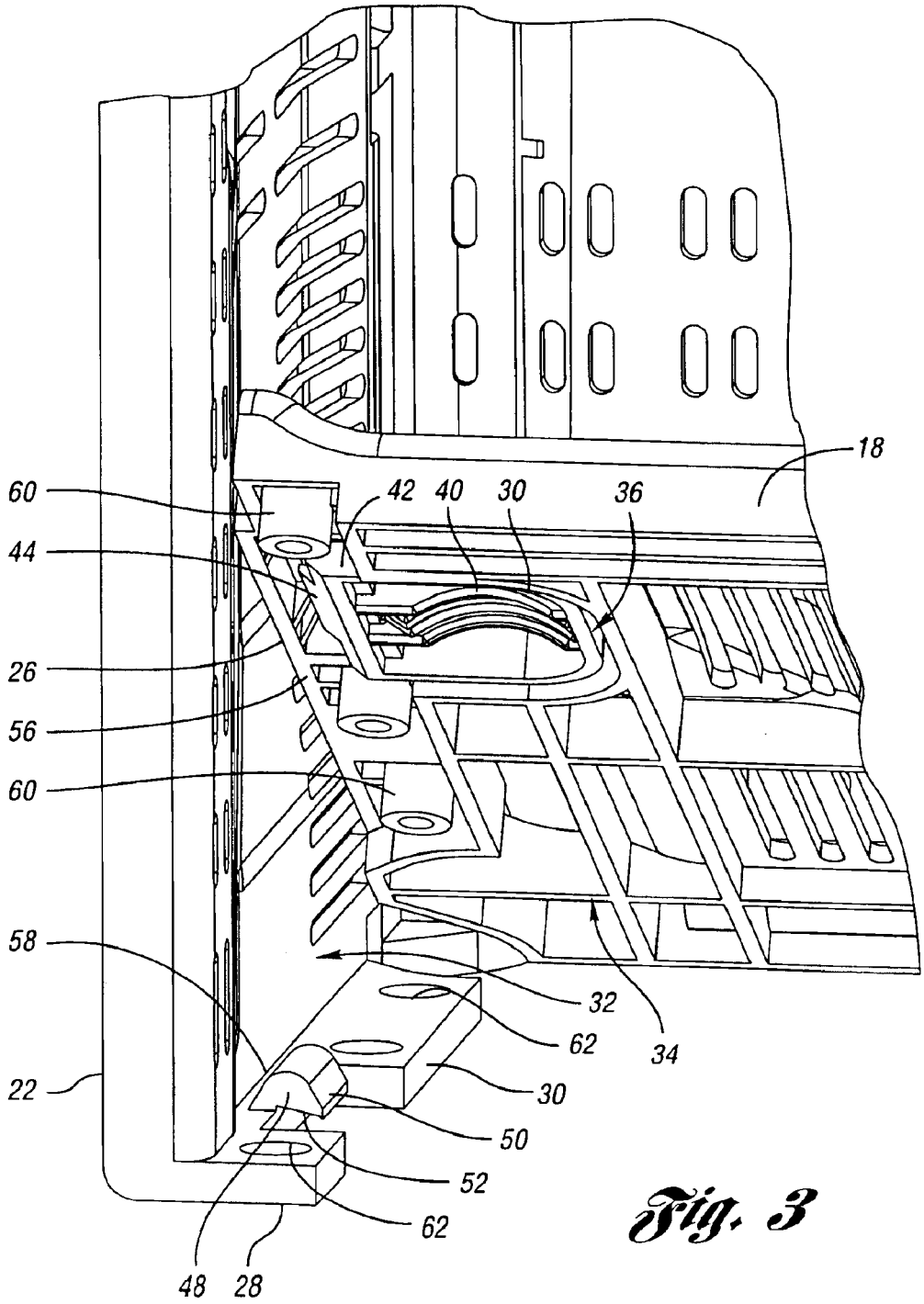
FIG. 3 is a partial top, isometric view of the exemplary container as it is otherwise illustrated in FIG. 2.
Figure 4:
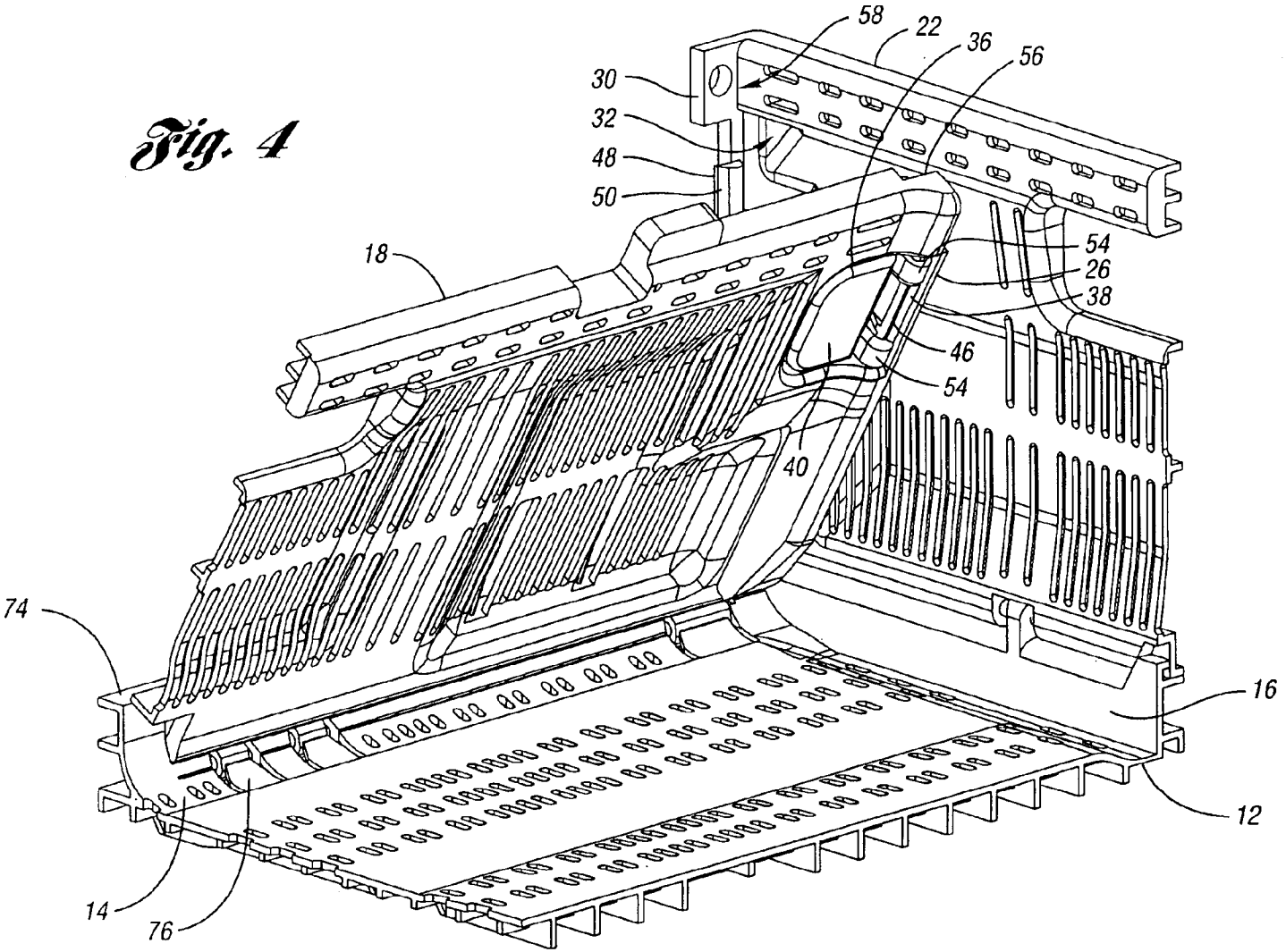
FIG. 4 is a view from within the exemplary container as it is otherwise illustrated in FIG. 2, looking outwardly at the first and second side panels and further illustrating the interface between the container's bottom panel and the basal edge of the first side panel.

Returning to the Drawings, when the container 10 is "assembled" as illustrated in FIG. 1 with the side and end walls 18, 22 pivoted to their respective raised positions relative to the base 12, the lateral edges 26 of each side wall 18 are releasably interlocked with the respective adjacent lateral edges 28 of the end walls 22. More specifically, as best seen in FIGS. 2 and 3, the end walls 22 each include a flange 30 projecting inwardly from the end wall's inner face 32 proximate to each of its lateral edges 28. When the side and end walls 18, 22 are in their respective raised positions, opposed pairs of the end wall flanges 30 overlie respective portions of the outer face 34 of each side wall 18 proximate to its lateral edges 26. In the container 10, each of the inwardly-projecting flanges 30 on the end walls 22 extends along substantially the entire length of its respective end wall lateral edge 28 to thereby provide greater lateral support for the side wall 18 with which it engages.

Referring to FIGS. 3–6, each lateral edge 26 of each side wall 18 also includes a latch member 36 having a base portion 38 mounted on the side wall 18 proximate to its respective lateral edge 26, and a lever arm portion 40 that extends generally away from the lateral edge 26. Each latch member 36 further includes an intermediate portion 42 disposed between the base portion 38 and the lever arm portion 40. The intermediate portion 42 includes a first camming surface 44 and a first shoulder 46 adjacent to the first camming surface 44.

Each lateral edge 28 of each end wall 22 correlatively includes an inward projection 48, for example, integrally molded with and projecting inwardly its respective end wall flange 30. The inward projection 48 has a second camming surface 50 with an adjacent shoulder 52. The respective camming surfaces 44, 50 and shoulders 46, 52 of each associated pair of latch members 36 and inward projections 48 are generally disposed at a same height above the base 12 when the side and end walls 18, 22 are pivoted to the raised position. In this manner, when the lateral edges 26 of the side walls 18 are raised and brought into engagement with the lateral edges 28 of the end walls 22, the associated pairs of camming surfaces 44, 50 engage to resiliently flex each latch member 36, predominantly along its base portion 38. The respective shoulders 46, 52 of each associated pair of latch members 36 and inward projections 48 then abuttingly engage to latch the side and end walls 18, 22 together.

Figure 5:
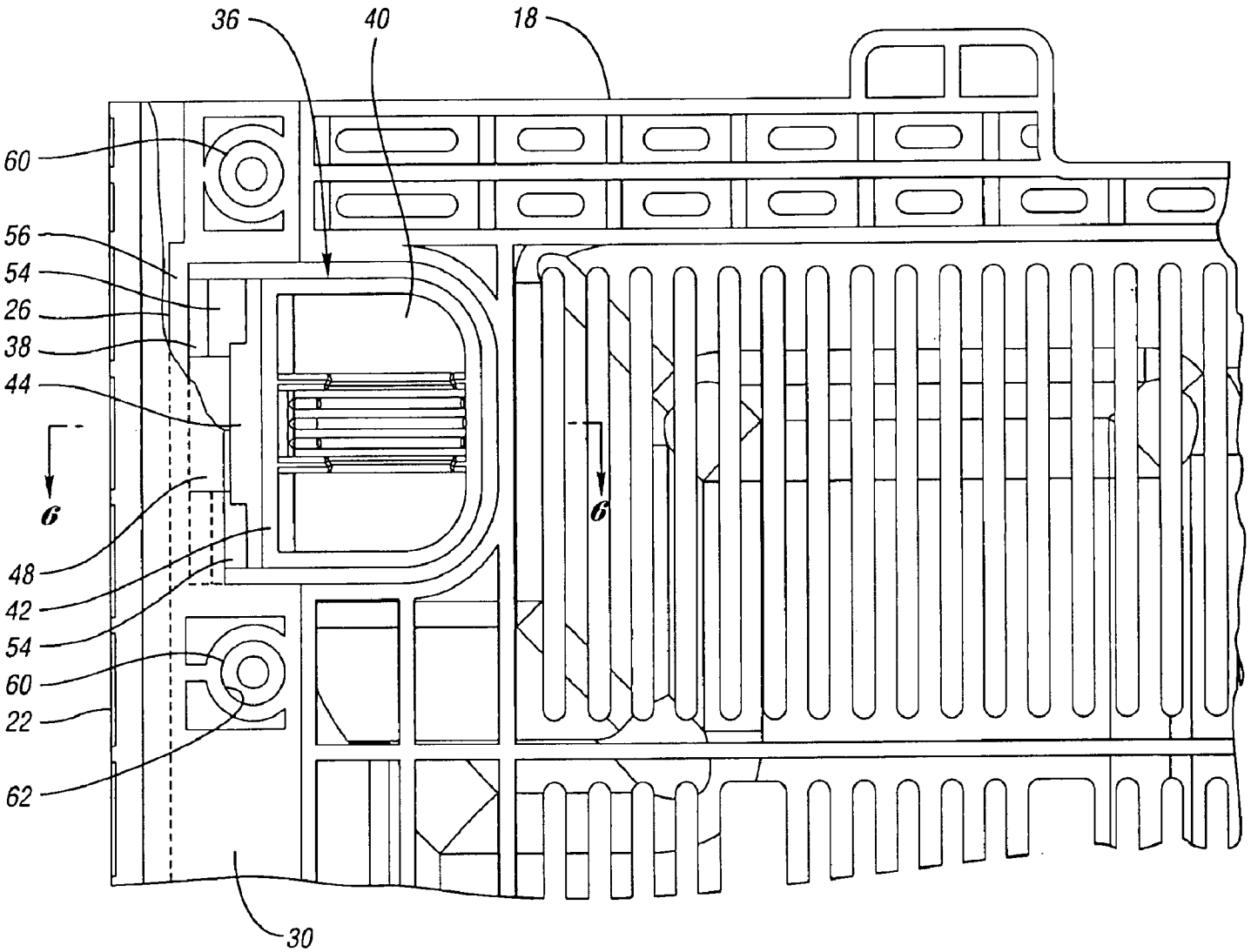
FIG. 5 is an elevation, partially broken away, of a corner of the assembled exemplary container as seen in FIG. 1 further illustrating a lateral edge of the first side panel and, particularly, its integrated latch member.
Figure 6:
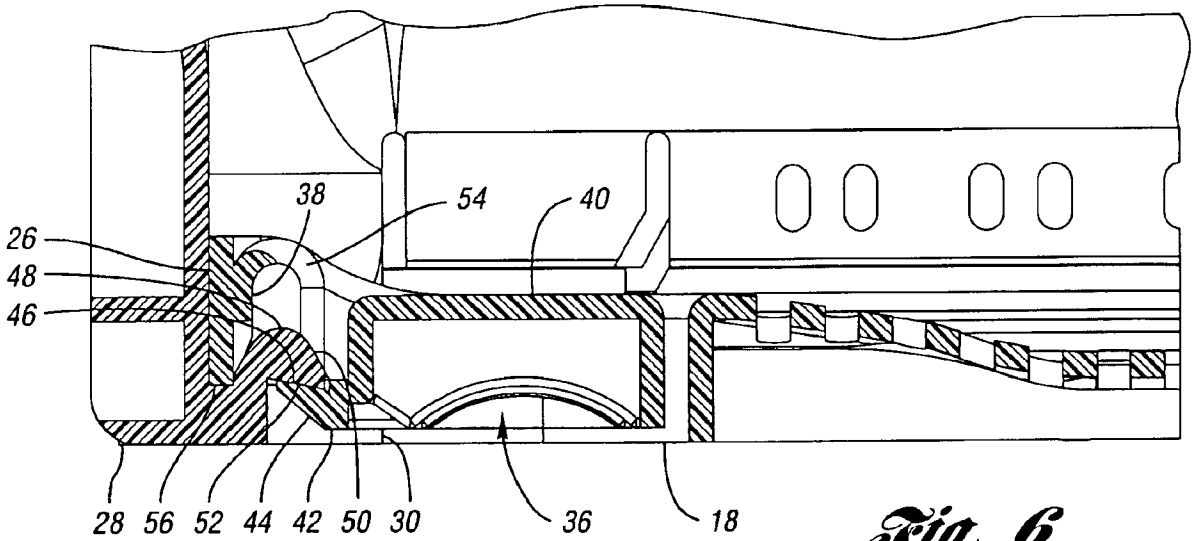
FIG. 6 is a cross-sectional view of the first side panel taken along line 6—6 of FIG. 5.
Figure 8:
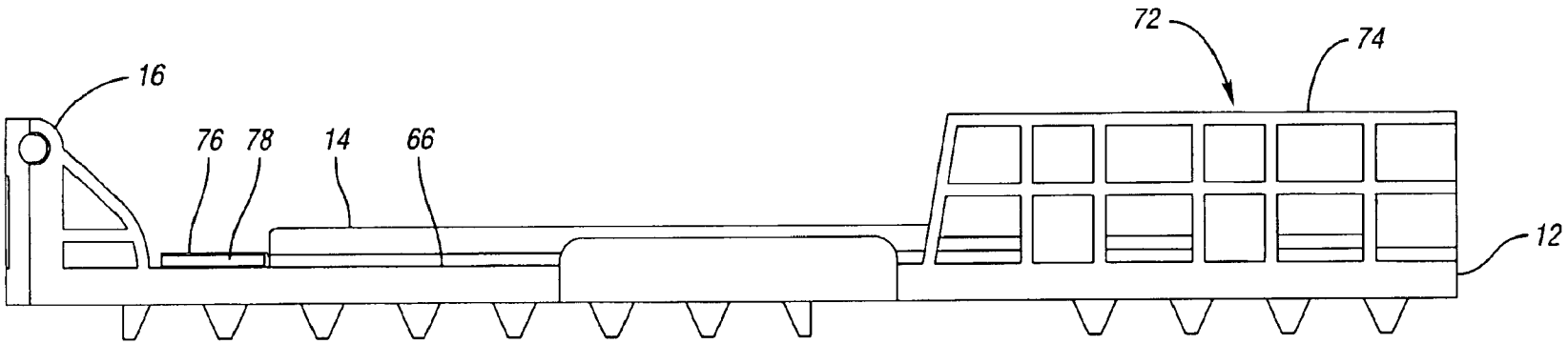
FIG. 8 is a partial elevation of the portion of the bottom panel illustrated in FIG. 7, similarly illustrating the recessed shelf, the outwardly-extending stop members, and a further outboard side wall bolster.
Figure 7:
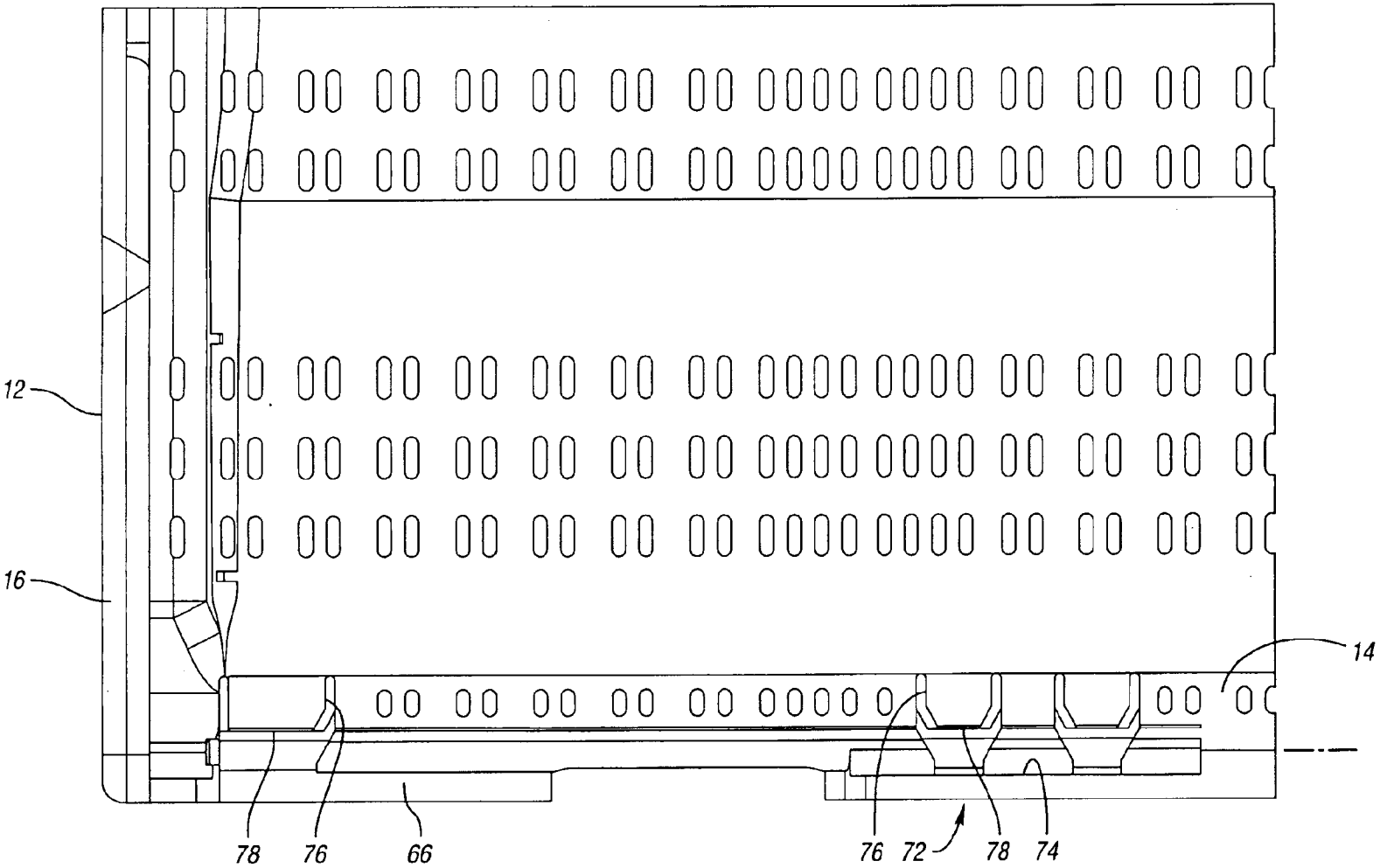
FIG. 7 is a partial plan view of the bottom panel only, further illustrating one of the several recessed shelves defined along the bottom panel's peripheral edge, and a plurality of outwardly-extending resilient stop members which serve to bolster the basal edge of the first side panel when it is in the raised position.
Figure 9:
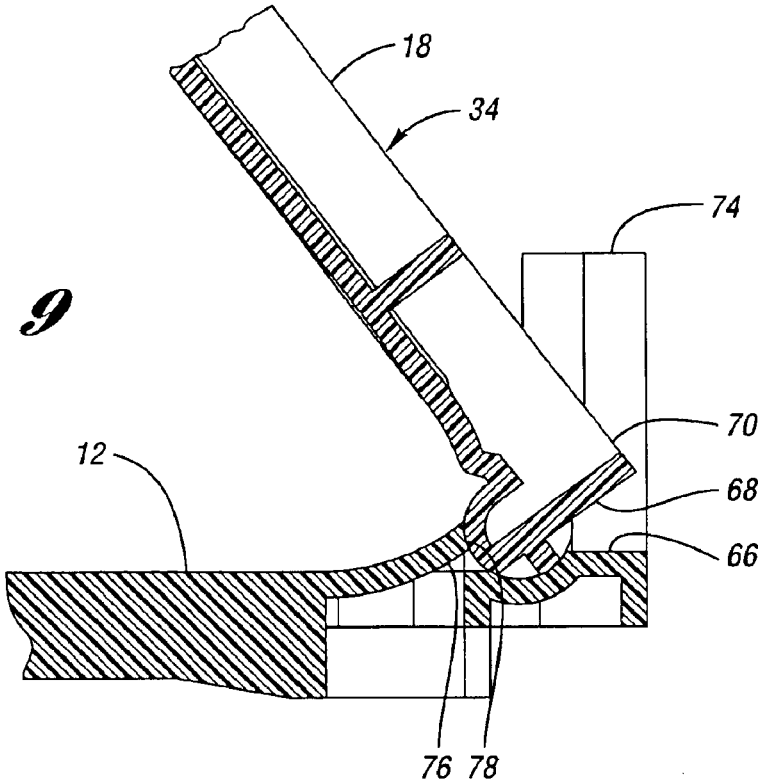
FIG. 9 is a partial cross-sectional view of the interface between the bottom panel and the basal edge of the first side panel as it is otherwise illustrated in FIG. 2, taken along line 9—9 as shown in FIG. 2.
Figure 10:
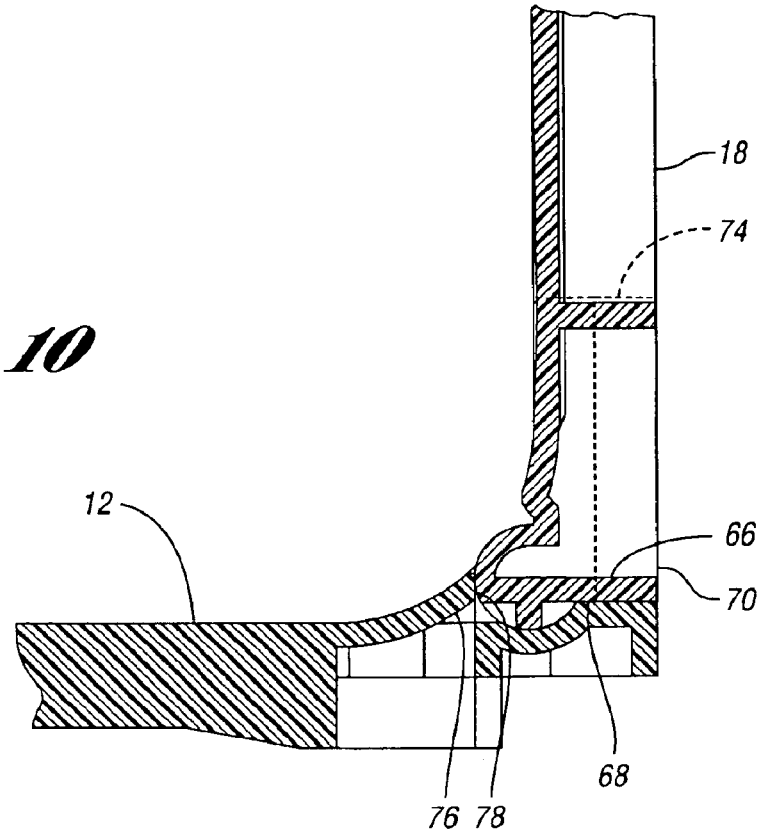
FIG. 10 is a cross-sectional view similar to that of FIG. 9, wherein the first side panel is pivoted to its raised position relative to the bottom panel such that a portion of the basal edge of the first panel is seated atop a recessed shelf defined in a portion of the bottom panel's peripheral edge.

In accordance with a feature of the invention, as best seen in FIGS. 5 and 6, the base portion 38 of each latch member 36 includes a pair of spaced legs 54 by which the latch member's intermediate portion 42 is coupled to its respective side wall lateral edge 26, with each leg 54 being disposed on a respective side of the latch member's camming surface 44 and associated shoulder 46. Most preferably, the legs trace an arcuate path as they extend from the side wall's lateral edge 26 to their respective outboard positions on the intermediate portion 42 of the latch member 36, and the material of the side walls 18 is preferably selected such that deflection of the latch member relative to the outer face of the first side panel generates both flexural or "in-plane" bending, and torsional bending of each leg 54. In this way, the latch members 36 of the container 10 feature an improved service life over known cantilevered latch members.

As best seen in FIGS. 3 and 5, each side wall 18 includes an integrally-molded strengthening rib 56 proximate to and, most preferably, defining each of its respective lateral edges 26, with the rib 56 extends generally perpendicular to the pivot axis 20 of the side wall 18 to thereby define a substantially-continuous first length along its respective side wall edge 26. The base portion 38 of each of the side wall's latch members 36 may therefore be conveniently integrally formed with the rib 56.

Referring again to FIGS. 3 and 4, the intersection of each flange 30 with the inner face 32 of each end wall 22 defines an interior corner 58 proximate to each of its lateral edges 28. When the side walls 18 are raised to engage the end wall flanges 30, the side wall ribs 56 are received in the corresponding interior corners 58 of the end walls 22. In this manner, the container 10 provides a nearly continuous engagement of the two lateral edges 26, 28 which serves to further protect the container's ultimate contents while further enhancing the structural integrity of the assembled container 10.

And, as best seen in FIGS. 2 and 3, the container's side walls 18 each include, proximate to each lateral edge 26, a plurality of locating members 60 that project outwardly from the panel's outer face 34. While the invention contemplates locating members 60 of any suitable configuration, by way of example only, the locating members 60 of the exemplary container 10 are raised, frustoconical bosses that are integrally molded with the side wall 18. The lateral edge flanges 30 of the end walls 22 each include a like number of sockets 62 that are adapted to receive the locating members 60 when the side walls 18 are pivoted into engagement with the end wall flanges 30.

In accordance with another feature of the invention, as the locating members 60 of the side walls 18 are received within the sockets 62 of the end walls 22, the locating members 60 guide the engagement of the respective camming surfaces 44, 50 of the latch members 36 and the end wall flange projections 48, thereby increasing latch service life. And, once the locating members 60 are fully received in the sockets 62, the locating members 60 and sockets 62 assist in maintaining the engagement of the opposed shoulders 46, 52 of the latch members 36 and the flange projections 48 until the latch members 36 are resiliently flexed by application of finger pressure on the latch member's lever arm portion 40.

In accordance with yet another feature of the invention, and as best seen in FIGS. 7–10, recessed shelves 66 are defined about portions of the peripheral edge of the base 12, for example, proximate to each lateral edge 26 of the container's side walls 18. When each side wall 18 is pivoted to the raised position, complementary portions 68 of the basal edge 70 of the side wall 18 pivots into engagement with corresponding recessed shelves 66. It will be appreciated that, by locating the recessed shelves 66 along the outermost portions of the peripheral edges of the base 12, the engagement of the side wall basal edges 70 cooperate with receipt of the side wall lateral edges 26 within the interior corners 58 of the end wall lateral edge flanges 30 (further supplemented by receipt of the locating members 60 within each flange's complementary sockets 62) to thereby provide enhanced lateral stability to the side walls 18 of the assembled container 10.

In accordance with yet another feature of the invention, other portions 72 of the peripheral edge of the base 12, for example, proximate to the midpoint of each side wall 18, include a raised flange 74 that overlies the side wall's outer face 34 when the side wall 18 is pivoted to the raised position. Still further, the container's base 12 also includes a plurality of integrally-molded, ramped or cantilevered stop members 76, each of which has a free end surface 78 that extends outwardly to engage the basal edge 60 of a respective side wall 18 when the side wall 18 is pivoted to the raised position. The cantilevered design of the stop members 76 facilitates assembly of the side walls 18 to the base 12, for example, wherein the hinge component of each side wall 18 is slid laterally into engagement with a complementary hinge component defined in the side wall's corresponding rail 14, with the cantilevered stop members 76 resiliently yielding and flexing downwardly relative to the base 12 as the hinge components mate.

The recessed shelves 66 and raised flanges 74 on the base 12 cooperate with the stop members 76 to precisely locate and laterally bolster the basal edge of each side wall 18 intermediate its lateral edges 26 when the side wall 18 is pivoted to the raised position, thereby improving the performance of the assembled container. As a further benefit, the recessed shelves 66, midpoint flanges 74 and stop members 76 of the base 12 prevent each side wall 18 from being pivoted beyond a relative vertical orientation with respect to the base 12, even if the end walls 22 are themselves urged outwardly to such an extent that the end wall edge flanges 30 on the end walls 22 do not otherwise engage and retain the side wall edges 26. As seen in FIG. 1, handles 80 are preferably defined in the side walls 18 generally above the midpoint flange 74 of the base 12 to facilitate the handling of the container 10.

While an exemplary embodiment according to the invention has been illustrated and described, it is not intended that this embodiment illustrate and describe all possible forms of the invention. Rather, the words used in the specification are words of description rather than limitation, and various changes maybe made within the scope of the appended claims. For example, while a rectangular container 10 is shown and described, the invention is not so limited and contemplates end walls 22 and side walls 18 of equal length forming a container having square dimensions, or any other shape feasible according to the desired size and use. And, while the exemplary container 10 is characterized as an inwardly-collapsing container, it will be readily appreciated that myriad aspects of the invention are equally well suited for use in connection with an outwardly-collapsing container. Similarly, while the locating members 60 of the exemplary container 10 are formed on the side walls 18 and the complementary sockets 62 are formed on the end wall edge flanges 30, it will be appreciated that these components can readily be reversed or mixed on the side and end walls 18, 22 without departing from their function as described above.

What is claimed is:

1. A collapsible container comprising:

a bottom panel defining a peripheral edge; and a plurality of side panels, each side panel being mounted on the bottom panel along a respective portion of the peripheral edge for pivoting movement about a respective pivot axis, wherein a first side panel includes an outer face and a lateral edge bordering the outer face, and a second side panel includes an inner face, a lateral edge bordering the inner face, and a flange projecting from the inner face along at least a portion of the lateral edge, the first and second side panels respectively pivoting to a raised position relative to the bottom panel such that the flange overlies the outer face as the lateral edge of the first side panel engages the lateral edge of the second side panel, wherein the first side panel includes a latch member having a base portion mounted on the first side panel proximate to the lateral edge thereof, a lever arm portion extending generally away from the lateral edge, and a first intermediate portion disposed between the base portion and the lever arm portion, the first intermediate portion including a first camming surface and a first shoulder adjacent to the first camming surface, and wherein the second side panel includes an inward projection having a second camming surface and a second shoulder adjacent to the second camming surface, the camming surfaces and shoulders being generally disposed at a same height above the bottom panel when the first and second side panels are respectively pivoted to the raised position.

2. The collapsible container of claim 1, wherein the inward projection projects from the flange.

3. The collapsible container of claim 1, wherein the first side panel includes a rib proximate to the lateral edge thereof extending generally perpendicular to the pivot axis of the first side panel, and wherein the base portion of the latch member is integrally formed with the rib.

4. The collapsible container of claim 3, wherein the second side panel includes an interior corner defined by an intersection of the inner face and the flange, and wherein the rib defines a substantially-continuous first length of a first portion of the outer face of the first side panel, the first length of the first portion of the outer face being received in the interior corner of the second side panel when the first and second side panels are respectively pivoted to the raised position.

5. The collapsible container of claim 1, wherein the first side panel includes at least one locating member projecting outwardly from the outer face proximate to the lateral edge of the first side panel, and wherein the flange includes at least one socket adapted to receive the at least one locating member when the first and second side panels are respectively pivoted to the raised position.

6. The collapsible container of claim 1, wherein a first portion of the peripheral edge of the bottom panel includes a recessed shelf, and wherein a basal edge of one side panel pivots into engagement with the recessed shelf when the one side panel is pivoted to the raised position.

7. The collapsible container of claim 6, wherein a second portion of the peripheral edge of the bottom panel proximate the first portion includes a raised flange that lies in front of the outer face of the one side panel when the one side panel is pivoted to the raised position.

8. The collapsible container of claim 6, wherein the bottom panel includes at least one integrally-molded, cantilevered stop member having a free end surface extending in the direction of the first portion of the peripheral edge that engages the basal edge of the one side panel when the one side panel is pivoted to the raised position.

9. The collapsible container of claim 1 wherein the lever arm portion of the latch member is selectively deflectable transversely to the first side panel in order to selectively release the latch member from the second side panel.

10. The collapsible container of claim 1 wherein the base portion of the latch member is at least substantially between the lever arm portion and the inner face of the second side panel when the first and second side panels are in the raised position.

11. The collapsible container of claim 1 wherein the base portion includes at least one arcuate leg between the lateral edge and the intermediate portion.

12. The collapsible container of claim 1 wherein the intermediate portion travels substantially in a plane parallel to the outer face of the first side panel when the latch member is deflected to engage or disengage the latch member.

13. The collapsible container of claim 1 wherein the intermediate portion extends toward a lateral center of the first panel as it extends away from the base portion.

14. The collapsible container of claim 1 wherein the intermediate portion is between the base portion and a lateral center of the first panel.

15. A collapsible container comprising:

a bottom panel defining a peripheral edge; and a plurality of side panels, each side panel being mounted on the bottom panel along a respective portion of the peripheral edge for pivoting movement about a respective pivot axis, wherein a first side panel includes an outer face and a lateral edge bordering the outer face, and a second side panel includes an inner face, a lateral edge bordering the inner face, and a flange projecting from the inner face along at least a portion of the lateral edge, the first and second side panels respectively pivoting to a raised position relative to the bottom panel such that the flange overlies the outer face as the lateral edge of the first side panel engages the lateral edge of the second side panel, wherein the first side panel includes a latch member having a base portion mounted on the first side panel proximate to the lateral edge thereof, a lever arm portion extending generally away from the lateral edge, and a first intermediate portion disposed between the base portion and the lever arm portion, the first intermediate portion including a first camming surface and a first shoulder adjacent to the first camming surface, wherein the base portion of the latch member includes a pair of spaced legs joined to the intermediate portion on either side of the camming surface, wherein the second side panel includes an inward projection having a second camming surface and a second shoulder adjacent to the second camming surface, the camming surfaces and shoulders being generally disposed at a same height above the bottom panel when the first and second side panels are respectively pivoted to the raised position.

16. The collapsible container of claim 15, wherein the legs of the base portion extend to respective positions outboard of the intermediate portion of the latch member such that deflection of the latch member relative to the outer face of the first side panel generates both flexural and torsional bending of each leg.

17. A collapsible container comprising:

a bottom panel having a peripheral edge, and a plurality of side panels, each side panel being mounted on the bottom panel along a respective portion of the peripheral edge for pivoting movement about a respective pivot axis between a collapsed position and a raised position, each side panel including a pair of diametrical lateral edges, each side panel pivoting to a raised position relative to the bottom panel such that each lateral edge of a given side panel interlockingly engages a lateral edge of an adjacent side panel, wherein one side panel includes an outer face and a basal edge bordering the outer face, wherein a first portion of the peripheral edge of the bottom panel includes a recessed shelf, wherein the recessed shelf is located below the pivot axis of the one side panel, and wherein a basal edge of the one side panel pivots into engagement with the recessed shelf when the one side panel is pivoted to the raised position, wherein a first side panel includes an outer face, wherein a second side panel adjacent to the first side panel includes an inner face and a flange projecting from the inner face along at least a portion of one lateral edge thereof, the first and second side panels respectively pivoting to the raised position such that the flange overlies the outer face as the one lateral edge of the first side panel engages one lateral edge of the second side panel, and wherein the first side panel includes at least one locating member projecting outwardly from the outer face proximate to the one lateral edge, and wherein the flange includes at least one socket adapted to receive the at least one locating member when the first and second side panels are respectively pivoted to the raised position to maintain the engagement of the basal edge of the one side panel with the recessed shelf when the one side panel is pivoted to the raised position.

18. The collapsible container of claim 17, wherein a second portion of the peripheral edge of the bottom panel proximate the first portion includes a raised flange that lies in front of the outer face of the one side panel when the one side panel is pivoted to the raised position.

19. The collapsible container of claim 17, wherein the one side panel includes an inwardly-facing abutting surface proximate to the basal edge, and wherein the bottom panel includes at least one integrally-molded, cantilevered stop member having a free end surface extending in the direction of the first portion of the peripheral edge that engages the inwardly-facing abutting surface of the one side panel when the one side panel is pivoted to the raised position.

20. The collapsible container of claim 17, wherein the first side panel includes a latch member having a base portion mounted on the first side panel proximate to the one lateral edge thereof, a lever arm portion extending generally away from the lateral edge, and a first intermediate portion disposed between the base portion and the lever arm portion, the first intermediate portion including a first camming surface and a first shoulder adjacent to the first camming surface, and wherein the second side panel includes an inward projection having a second camming surface and a second shoulder adjacent to the second camming surface, the camming surfaces and shoulders being generally disposed at a same height above the bottom panel when the first and second side panels are respectively pivoted to the raised position.

21. The collapsible container of claim 20, wherein the inward projection projects from the flange.

22. The collapsible container of claim 20, wherein the first side panel includes a rib proximate to the lateral edge thereof extending generally perpendicular to the pivot axis of the first side panel, and wherein the base portion of the latch member is integrally formed with the rib.

23. The collapsible container of claim 20, wherein the base portion of the latch member includes a pair of spaced legs joined to the intermediate portion on either side of the camming surface.

24. The collapsible container of claim 23, wherein the legs of the base portion extend to respective positions outboard of the intermediate portion of the latch member such that deflection of the latch member relative to the outer face of the first side panel generates both flexural and torsional bending of each leg.

* * * * *